United States Patent [19]

Marshall et al.

[11] 4,103,068

[45] Jul. 25, 1978

[54] POLYESTER FILAMENTARY YARNS

[75] Inventors: Robert Moore Marshall, Chester; Kimon Constantine Dardoufas, Richmond, both of Va.

[73] Assignee: Allied Chemical Corporation, Morris Township, Morris County, N.J.

[21] Appl. No.: 781,913

[22] Filed: Mar. 28, 1977

Related U.S. Application Data

[63] Continuation of Ser. No. 653,974, Jan. 30, 1976, abandoned.

[51] Int. Cl.[2] ..... B32B 27/00; D02G 3/00

[52] U.S. Cl. ..... 428/395; 57/140 C; 252/8.6; 252/8.9; 428/375; 428/378

[58] Field of Search ..... 428/375, 394, 395, 378; 252/8.6, 8.75, 8.9; 57/140 C

[56] References Cited

U.S. PATENT DOCUMENTS 3,672,977 6/1972 Dardoufas ..... 428/395

3,687,721 8/1972 Dardoufas ..... 252/8.6 X

*Primary Examiner*—Lorraine T. Kendell

*Attorney, Agent, or Firm*—Fred L. Kelly

[57] ABSTRACT

Synthetic filamentary yarn comprised of polyethylene terephthalate filaments which are first treated with a liquid composition consisting essentially of refined coconut oil, about 10 to 20 weight percent of said composition of a stearic acid ester of a branched chain alcohol having 14–15 carbon atoms, ethoxylated tallow amine, ethoxylated lauryl alcohol, sodium salt of alkylarylsulfonate, dinonyl-sodium-sulfosuccinate, and white mineral oil having a boiling point of between 510° and 620° F., and then treated with a liquid composition consisting essentially of a compound selected from the group consisting of glycerol monooleate and decaglycerol tetraoleate with ethoxylated tall oil fatty acids, a compound selected from the group consisting of sulfated glycerol trioleate and ethoxylated tallow amine, and a stearic acid ester of a branched chain alcohol having 14–15 carbon atoms.

4 Claims, No Drawings

POLYESTER FILAMENTARY YARNS

This is a continuation of application Ser. No. 653,974, filed Jan. 30, 1976, and now abandoned.

BACKGROUND OF THE INVENTION

This invention relates to multifilament polyester yarns and particularly to improved multifilament polyethylene terephthalate yarns for industrial uses. More particularly, it relates to an improved multifilament polyethylene terephthalate yarn and a new fiber finishing process for polyethylene terephthalate yarns in which novel fiber finish compositions are applied to said yarns.

Many fiber finish compositions are known. Some are quite specific in composition and relate to specific type fibers. Small changes in fiber finish composition frequently result in tremendous improvements not only in processing but also in end use of the fiber.

Polyester industrial yarn finishes generally comprise a combination of a lubricant, an antistat, and several emulsifiers. For example, U.S. Pat. No. 3,672,977 discloses an improved polyester industrial yarn which is produced by first treating the yarn with a spin finish comprising hexadecyl stearate, refined coconut oil, ethoxylated tallow amine, ethoxylated lauryl alcohol, sodium salt of alkylarylsulfonate, dinonyl-sodium-sulfosuccinate, 4,4'-thio-bis-(3-methyl-6-tert-butylphenol) and white mineral oil, and then treating the yarn with an overfinish comprising glycerol monooleate, decaglycerol tetraoleate, ethoxylated tall oil fatty acids, sulfated glycerol trioleate, ethoxylated tallow amine and hexadecyl stearate. Although the process and product of this patent are certainly an important improvement in this art, research in this field has continued in an effort to further improve the yarn, and in particular to produce a yarn suitable for making tire cord which gives improved performance in tires and which does not turn yellow on exposure to light.

SUMMARY OF THE INVENTION

Therefore, it is an object of this invention to provide an improved polyester multifilament yarn which does not turn yellow on exposure to light. It is another object of this invention to provide a method of finishing polyester tire yarn which results in an improved performance of the fiber in tires in accordance with the extended DOT High Speed Performance Test.

These and other objects are accomplished in accordance with this invention by production of a synthetic filamentary yarn comprised of polyethylene terephthalate filaments which are first treated with from about 0.3 to about 0.6 weight percent based on the weight of the yarn of a liquid composition consisting essentially of about 10 to about 20 weight percent of said composition of refined coconut oil, about 10 to about 20 weight percent of said composition of a stearic acid ester of a branched chain alcohol having 14–15 carbon atoms, about 3.0 to about 6.0 weight percent of said composition of ethoxylated tallow amine, about 10 to about 20 weight percent of said composition of ethoxylated lauryl alcohol, about 8.0 to about 12.0 weight percent of said composition of sodium salt of alkylarylsulfonate, about 1.0 to about 3.0 weight percent of said composition of dinonyl-sodium-sulfosuccinate, and about 35 to 50 weight percent of said compoosition of white mineral oil having a boiling point of between 510° and 620° F., wherein at least about 0.15 to about 0.30 weight percent is retained on said yarn; and then treated with from about 0.7 to about 1.2 weight percent on said yarn of a liquid composition consisting essentially of about 13 to about 25 weight percent of said composition of a compound selected from the group consisting of glycerol monooleate and decaglycerol tetraoleate with ethoxylated tall oil fatty acids, about 12 to about 20 weight percent of said composition of a compound selected from the group consisting of sulfated glycerol trioleate and ethoxylated tallow amine, and about 55 to about 75 weight percent of said composition of a stearic acid ester of a branched chain alcohol having 14–15 carbon atoms.

DESCRIPTION OF THE PREFERRED EMBODIMENTS

Polyester yarns are known to be drawn at elevated temperatures, and thermal variability of the yarn depends upon the properties of the finish which effects processing performance as well as yarn physical properties. Therefore, properties such as low specific heat and low heat of vaporization of the volatile components and the lowest finish level required for fiber protection are essential to minimize heat losses for good fiber processing performance. This illustrates the inferior performance of all aqueous finishes in comparison to the nonaqueous finishes which can be applied at a level significantly lower for the same or equivalent percent solids on yarn and have much lower specific heat and heat of vaporization compared to aqueous or water based material.

The preferred composition for use as the spin or process finish in accordance with this invention consists of a non-aqueous homogeneous blend of lubricants, emulsifiers, antistat and wetting agent. The blend is a clear liquid free of suspended solids, and having a viscosity of about 27 centiposes at room temperature, a surface tension of about 32 dynes per centimeter and a contact angle on polyester of about 9°, which insures proper wetting ability for uniform distribution of the composition. The lubricating and continuous phase of the preferred composition consists of about 40 weight percent mineral oil of low viscosity of about 40 SSU at 100° F., flash point of 260° F., and boiling range of about 510° to 620° F., about 15 weight percent coconut oil and about 15 weight percent of a stearic acid ester of a blend of $C_{14-15}$ branched chain alcohols, said ester having low volatility and excellent heat stability. The most preferred stearic acid ester is prepared from a mixture of secondary alcohols having the general chemical structure

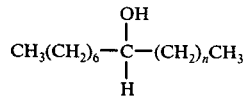

where $n$ is 5–6. The remainder of the spin finish preferably consists of about 10 weight percent of sodium petroleum sulfonate (sodium salt of alkylarylsulfonate) which is an excellent emulsifier and antistat due to its high ionization, about 5 weight percent of ethoxylated (20 ETO) tallow amine which is an excellent emulsifier and antistat, about 13 weight percent of ethoxylated (4 ETO) lauryl alcohol emulsifier coupling agent, and about 2 weight percent of sodium salt of dinonyl-sodium-sulfosuccinate which is an excellent wetting agent.

The spin finish composition is applied onto the yarn in such a way as to allow about 0.3 to about 0.6 weight percent of said composition to be initially applied, with from about 0.15 to about 0.30 weight percent retained on the yarn to protect the fiber surface and furnish required lubricity, and antistatic properties. During the heat treatment of the yarn subsequent to the application of the spin finish composition, about 40 to about 50 weight percent of the composition is volatilized. The volatiles consist mainly of the low viscosity mineral oil. The volatiles are condensed and can be recovered through an exhaust system. The remaining spin finish composition provides adequate surface lubrication, antistatic properties and wetting properties to protect the yarn surface during the subsequent drawing operation. A particular advantage of this spin finish composition is that when it is exposed to extremely high temperatures as required in a polyester spin draw or conventional spinning and drawing process, it suffers substantially no decomposition, thus preventing possible deposits on processing rolls and other threadpath components.

The process finish composition is critical not only because of its composition which provides all requirements of lubrication, antistatic properties and protection from heat degradation, but also because of its special physical properties which are essential for uniformity of application and efficient fiber thermal treatment. First, low viscosity of less than 40 centipoises at 25° C. by Brookfield Viscometer, for application at room temperature is critical. Second, good wetting ability measured by contact angle method on polyester film is necessary; a contact angle of less than 10° gives substantially ideal conditions of finish spreadability. Third, the multicomponent spin process finish composition is a uniform blend, water clear, and free of any suspended solids. In order to achieve this, an almost perfect HLB (hydrophylic-lipophylic balance) is achieved without adverse effects on any of the other essential properties of the finish composition. Even a minor modification of the ratio of the composition ingredients results in an unstable blend of cloudy appearance with suspended solids or complete separation of layers. Fourth, the composition yields low specific heat and low heat of vaporization of the more volatile components which provides good conditions to minimize heat losses during the thermal treatment of the fiber. And, fifth, the composition is heat stable when exposed to high process temperatures and undergoes substantially no chemical degradation even after partial volatilization.

The yarn finish or overfinish composition is applied onto the yarn in such a way as to allow about 0.7 to about 1.2 weight percent to remain on said yarn to improve its translational efficiency to tensilized cord, adhesion, heat stability, fatigue and tire durability properties. The yarn or overfinish composition can be applied at any stage of the process subsequent to the drawing stage, thus yielding the possibilities of tailoring the surface properties of the fiber by use of additives for improving adhesion, thermal stability, fatigue, etc.

The preferred yarn finish composition for use as the overfinish or yarn finish in accordance with this invention consists essentially of about 6 weight percent of said composition of glycerol monooleate, about 5 weight percent of said composition of decaglycerol tetraoleate, about 8 weight percent of said composition of ethoxylated tall oil fatty acids, about 12 weight percent of said composition of sulfated glycerol trioleate, about 4 weight percent of said composition of ethoxylated tallow amine, and about 65 weight percent of said composition of a stearic acid ester of a blend of $C_{14-15}$ branched chain alcohols, most preferably a stearic acid ester of a mixture of secondary alcohols having the general structure

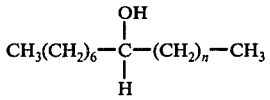

where $n$ is 5–6.

The yarns of this invention can be processed by any spin draw process or spinning and separately drawing process available to the art, using any suitable polyester which provides a high tenacity yarn of about 9 grams per denier and minimum elongation of about 13 percent.

Certain terms referred to within the specification and claims are defined below.

The "DOT High Speed Performance Test" refers to the Department of Transportation test for high speed performance of new pneumatic tires for passenger cars as described in Motor Vehicle Safety Standard 109 (see Federal Register, Volume 32, Number 222, November 16, 1967, Part II). Briefly stated, the tire is mounted on a test wheel and loaded as specified in the test. After running for 2 hours at 50 m.p.h. the tire is allowed to cool to 100°±5° F. and the inflation pressure is adjusted. The tire is then tested at 75 m.p.h. for 30 minutes, 80 m.p.h. for 30 minutes, and 85 m.p.h. for 30 minutes. For purposes of the present invention, the test was extended, i.e., the speed was further increased 5 m.p.h. every half hour until the tire failed, and results were reported in total miles to failure.

The following example illustrates the present invention and the advantages obtained thereby. Parts and percentages are by weight unless otherwise indicated.

EXAMPLE 1

For comparative testing, a polyethylene terephthalate tire yarn was prepared as described in U.S. Pat. No. 3,672,977, i.e., a 1300 denier, 192 filament yarn was prepared comprised of polyethylene terephthalate filaments treated with about 0.45 percent based on the weight of the yarn of a liquid spin finish consisting of 14.7 parts refined coconut oil, 14.7 parts hexadecyl stearate, 12.7 parts ethoxylated lauryl alcohol, 9.8 parts sodium salt of alkylaryl sulfonate, 4.9 parts ethoxylated tallow amine, 2 parts of dinonyl-sodium-sulfosuccinate, 2 parts 4,4'-thio-bis(6-tert-butyl-m-cresol) and 39.2 parts mineral oil having a boiling point between 510° and 620° F. Drawing performance of the yarn was excellent. Finish oil remaining on the fiber was 0.2 weight percent.

An overfinish was then applied to the drawn yarn as described in U.S. Pat. No. 3,672,977. The overfinish was applied by means of a kiss roll to give a final total oil on yarn of 1.1 weight percent. The overfinish had the following composition: 63.7 parts hexadecyl stearate, 5.9 parts glycerol monooleate, 4.9 parts decaglycerol tetraoleate, 7.8 parts ethoxylated tall oil fatty acid, 11.8 parts sulfated glycerol trioleate, 3.9 parts ethoxylated tallow amine, and 2 parts 4,4' thiobis(6-tert-butyl-m-cresol). This sample was designated Yarn A.

To demonstrate the present invention, another yarn sample was produced in the same manner described above except that a spin finish was applied consisting of 15 parts of a stearic acid ester of a mixture of secondary alcohols having the general structure

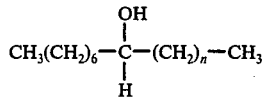

where $n$ is 5–6, 15 parts refined coconut oil, 13 parts of ethoxylated lauryl alcohol, 2 parts of dinonyl-sodium-sulfosuccinate, 5 parts ethoxylated tallow amine, 10 parts of sodium salt of alkylarylsulfonate, and 40 parts mineral oil having a boiling range between 510 and 620° F. Drawing performance was excellent and less fuming was observed during drawing (as compared with Sample A).

An overfinish was then applied to the drawn yarn to give a final oil on yarn of 1.1 weight percent. The overfinish had the following composition: 65 parts of a stearic acid ester of a mixture of secondary alcohols having the general structure

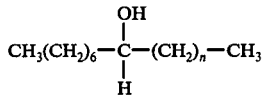

where $n$ is 5–6, 6 parts glycerol monooleate, 5 parts decaglycerol tetraoleate, 8 parts ethoxylated tall oil fatty acid, 12 parts sulfated glycerol trioleate, and 4 parts ethoxylated tallow amine. This sample was designated Yarn B.

The two yarn samples were twisted and plied into greige cord. The resulting cords were tensilized by a standard tensilization procedure and the tensilized cords were used to make standard automobile passenger tires in a tire production plant. Ten tires were built per cord sample, using yarns A and B as the reinforcing cord. All of these tires were used for testing.

The tire were tested in accordance with the above-described "DOT High Speed Performance Test", and then the test was extended at higher speeds as described above until the tires failed. Three tires were tested for each yarn sample, and results are furnished in Table I below as an average of the total miles to failure of the tires. In addition, the range for each sample is shown in parentheses beside each average.

TABLE I

| Sample | High Speed Performance, Total Miles to Failure |
|---|---|
| Yarn A | 509 (11) |
| Yarn B | 556 (15) |

These results show that tires prepared from Yarn B are significantly better than those prepared from Yarn A. Moreover, Yarn A showed severe yellowing on exposure to light, whereas Yarn B showed no yellowing on exposure to light.

In further tests of tires made from Yarn A and Yarn B, new untested tires were cut into one inch strips perpendicular to the tread, and rubber was pulled away from the cord in a chamber heated to 250° F. The appearance of the cord was graded on a scale from 0 to 5, where 5 represents a sample in which no cord is visable and zero represents complete cord exposure. In average of twelve tests, Yarn A gave a visual rating of 4.3 and Yarn B gave a visual rating of 4.6. These data further confirm that tires prepared from Yarn B are significantly better than those prepared from Yarn A.

We claim:

1. A synthetic filamentary yarn comprised of polyethylene terephthalate filaments which are first treated with from about 0.3 to about 0.6 weight percent based on the weight of the yarn of a liquid composition consisting essentially of about 10 to about 20 weight percent of said composition of refined coconut oil, about 10 to about 20 weight percent of said composition of a stearic acid ester of a branched chain alcohol having 14–15 carbon atoms, about 3.0 to about 6.0 weight percent of said composition of ethoxylated tallow amine, about 10 to about 20 weight percent of said composition of ethoxylated lauryl alcohol, about 8.0 to about 12.0 weight percent of said composition of sodium salt of alkylarylsulfonate, about 1.0 to about 3.0 weight percent of said composition of dinonyl-sodium-sulfosuccinate, and about 35 to 50 weight percent of said composition of white mineral oil having a boiling point of between 510° and 620° F., wherein at least about 0.15 to about 0.30 weight percent is retained on said yarn; and then treated with from about 0.7 to about 1.2 weight percent on said yarn of a liquid composition consisting essentially of about 13 to about 25 weight percent of said composition of a compound selected from the group consisting of glycerol monooleate and decaglycerol tetraoleate with ethoxylated tall oil fatty acids, about 12 to about 20 weight percent of said composition of a compound selected from the group consisting of sulfated glycerol trioleate and ethoxylated tallow amine, and about 55 to about 75 weight percent of said composition of a stearic acid ester of a branched chain alcohol having 14–15 carbon atoms.

2. The yarn of claim 1 wherein the stearic acid ester is prepared from a mixture of secondary alcohols having the general chemical structure

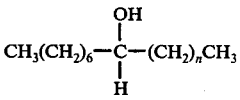

where $n$ is 5–6.

3. A synthetic filamentary yarn comprised of polyethylene terephthalate filaments which are first treated with from about 0.3 to about 0.6 weight percent based on the weight of the yarn of a liquid composition consisting essentially of about 15 weight percent of said composition of refined coconut oil, about 15 weight percent of said composition of a stearic acid ester of a branched chain alcohol having 14–15 carbon atoms, about 5 weight percent of said composition of ethoxylated tallow amine, about 13 weight percent of said compositon of ethoxylated lauryl alcohol, about 10 weight percent of said composition of sodium salt of alkylarylsulfonate, about 2 weight percent of said composition of dinonyl-sodium-sulfosuccinate, and about 40 weight percent of said composition of white mineral oil having a boiling point of between 510° and 620° F., wherein at least about 0.15 to about 0.30 weight percent is retained on said yarn; and then treated with from about 0.7 to about 1.2 weight percent on said yarn of a liquid composition consisting essentially of about 13 to about 25 weight percent of said composition of a compound selected from the group consisting of glycerol monooleate and decaglycerol tetraoleate with ethoxylated tall oil fatty acids, about 12 to about 20 weight percent of said composition of a compound selected from the group consisting of sulfated glycerol trioleate and ethoxylated tallow amine, and about 55 to about 75 weight percent of said composition of a stearic acid ester of a branched chain alcohol having 14–15 carbon atoms.

4. The yarn of claim 3 wherein the stearic acid ester is prepared from a mixture of secondary alcohols having the general chemical structure

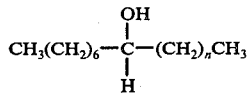

where $n$ is 5–6.

* * * * *